US008183155B1

(12) United States Patent
Little et al.

(10) Patent No.: US 8,183,155 B1
(45) Date of Patent: May 22, 2012

(54) LOWER PROFILE CONNECTOR ASSEMBLY

(75) Inventors: Terrance F. Little, York, PA (US); Robert Colantuono, Dover, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/075,182

(22) Filed: Mar. 30, 2011

(51) Int. Cl.
*H01R 13/10* (2006.01)

(52) U.S. Cl. ..... 438/682; 439/682

(58) Field of Classification Search ..... 439/682, 439/74, 494, 496, 660, 83, 65, 66
See application file for complete search history.

(56) References Cited

U.S. PATENT DOCUMENTS 5,741,144 A * 4/1998 Elco et al. ..... 439/101
5,746,608 A * 5/1998 Taylor ..... 439/70
6,093,035 A * 7/2000 Lemke et al. ..... 439/83
6,183,268 B1 * 2/2001 Consoli et al. ..... 439/74
6,193,561 B1 * 2/2001 Harting et al. ..... 439/682
6,328,577 B1 * 12/2001 Azuma ..... 439/83
6,506,081 B2 * 1/2003 Blanchfield et al. ..... 439/682
7,278,861 B2 * 10/2007 Kishi et al. ..... 439/74
7,410,364 B2 * 8/2008 Kishi et al. ..... 439/74
7,476,110 B2 * 1/2009 Lemke et al. ..... 439/83
7,744,377 B2 * 6/2010 Wu et al. ..... 439/74
7,748,993 B2 * 7/2010 Midorikawa et al. ..... 439/74
7,766,666 B1 * 8/2010 Chen et al. ..... 439/65
7,794,238 B2 * 9/2010 Chen et al. ..... 439/74
7,794,289 B1 * 9/2010 Chen et al. ..... 439/682
7,845,958 B2 * 12/2010 Hoshino et al. ..... 439/74
7,946,888 B2 * 5/2011 Wu et al. ..... 439/626
7,985,099 B2 * 7/2011 Wu ..... 439/626

* cited by examiner

*Primary Examiner* — Tulsidas C Patel
*Assistant Examiner* — Harshad Patel
(74) *Attorney, Agent, or Firm* — Wei Te Chung; Andrew C. Cheng; Ming Chieh Chang

(57) ABSTRACT

A connector assembly (1000) includes a first connector (100) including a first insulative housing (11), a plurality of first terminals (12) supported by the first insulative housing, each first contact having a body portion and two contacting portions (124) connected with lateral edges of the body portion; a second connector (200) including a second insulative housing (21), a plurality of second terminals (22) supported by the second insulative housing, each second terminal having a body portion and a blade type contacting portion (224); and wherein the contacting portion (224) of each second terminal is sandwiched between the two contacting portions (124) of the corresponding first terminal when the first connector mates with the second connector.

17 Claims, 8 Drawing Sheets

LOWER PROFILE CONNECTOR ASSEMBLY

BACKGROUND OF THE INVENTION

1. Field of the Invention

The present invention relates to a connector assembly, and more particularly to a lower profile connector assembly.

2. Description of Related Art

Conventionally, a board-to-board connector includes a plug connector mounted on a lower surface of a printed circuit board fitted into a receptacle mounted on an upper surface of another printed circuit board to electrically connect the printed circuit boards. For example, U.S. Pat. No. 7,845,958 issued on Dec. 7, 2010 to Hoshino et al. discloses a board-to-board connector assembly which includes a plug connector and a receptacle connector can mate with each other and retained together by a latching device. The plug connector has a plurality of first contacts and the receptacle connector has a plurality of second contacts. Each first contact dually touches a corresponding second contact to achieve reliable interconnection therebetween. In addition, a latching mechanism is needed to ensure reliable connection between the plug connector and the receptacle connector. Thus, the board-to-board connector assembly is complex and difficult in manufacturing process, even could not achieve reliable interconnection, especially as the plug connector and the receptacle connector become much smaller following lower profile requirement.

Hence, an improved connector assembly is required to overcome the problems of the prior art.

SUMMARY OF THE INVENTION

An object of the present invention is to provide a lower connector assembly.

Accordingly, to achieve above-mentioned object, a connector assembly comprises a first connector including a first insulative housing, a plurality of first terminals supported by the first insulative housing, each first contact having a body portion and two contacting portions connected with lateral edges of the body portion; a second connector including a second insulative housing, a plurality of second terminals supported by the second insulative housing, each second terminal having a body portion and a blade type contacting portion; and wherein the contacting portion of each second terminal is sandwiched between the two contacting portions of the corresponding first terminal when the first connector mates with the second connector.

The detailed features of the present invention will be apparent in the detailed description with appropriate reference to the accompanying drawings.

DETAILED DESCRIPTION OF THE INVENTION

Reference will now be made in detail to the preferred embodiment of the present invention.

Figure 1:
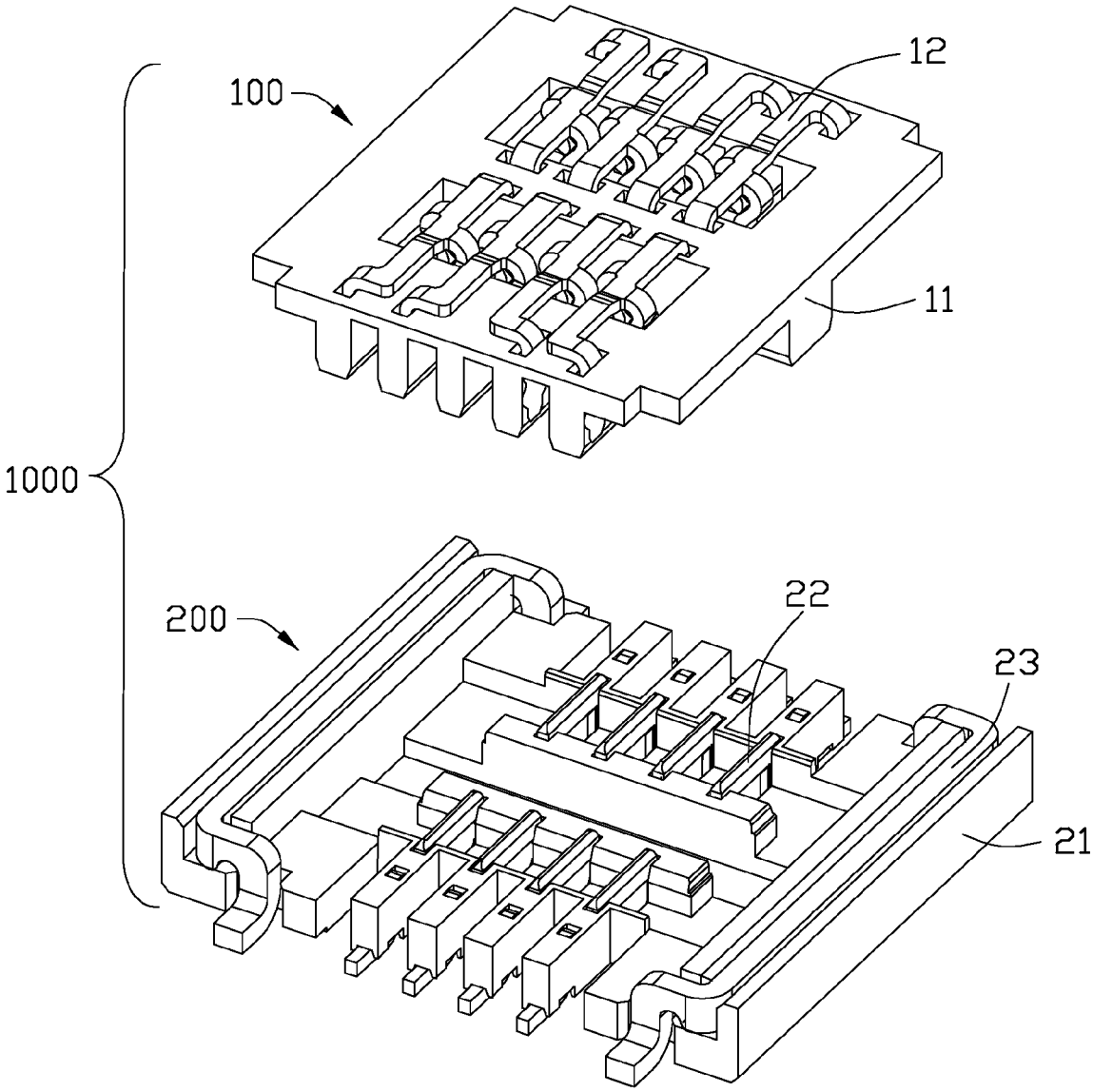
FIG. 1 is a perspective view of a connector assembly including a first connector separated from a second connector in accordance with the present invention.
Figure 2:
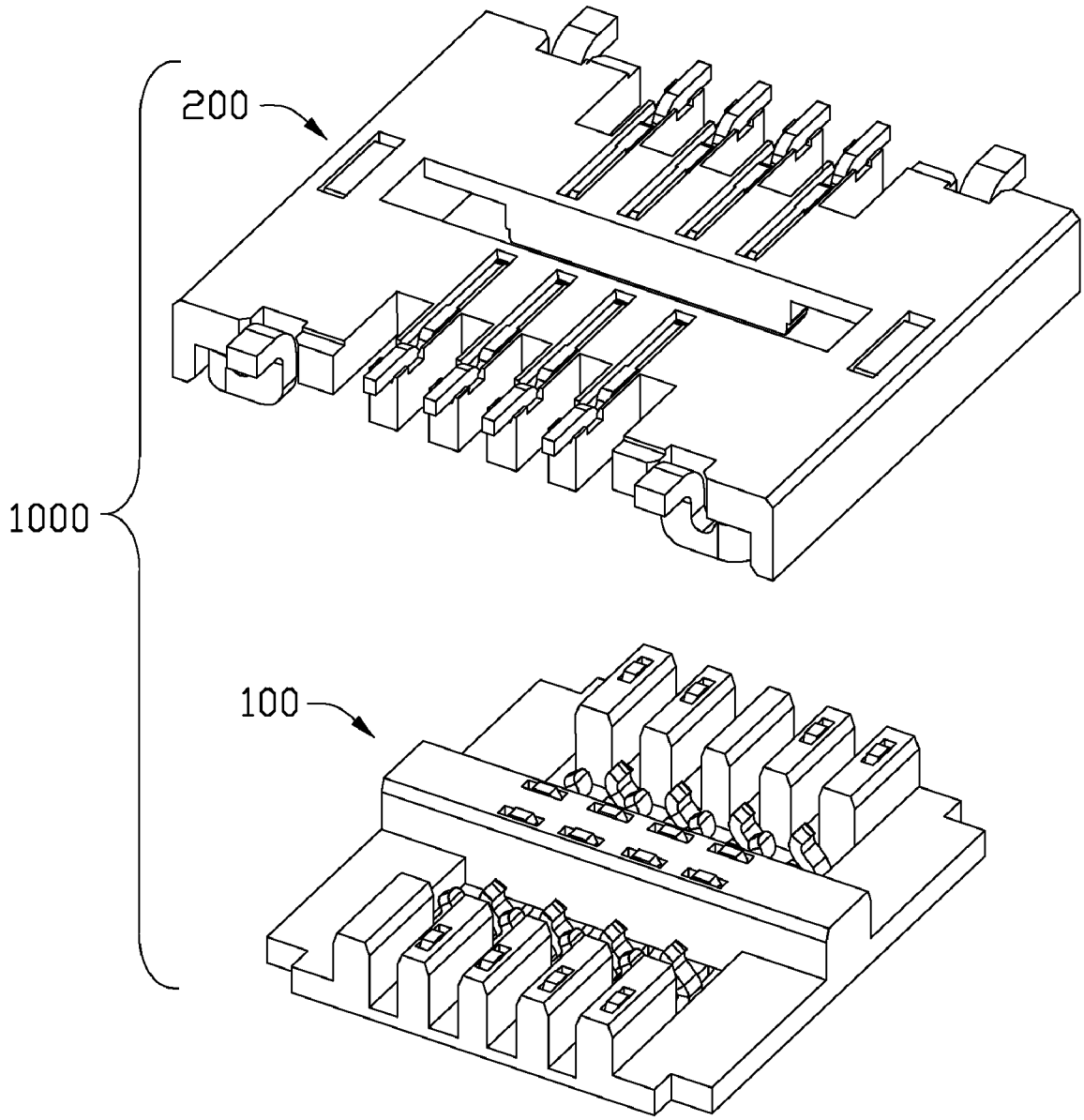
FIG. 2 is similar to FIG. 1, but viewed from other aspect.
Figure 3:
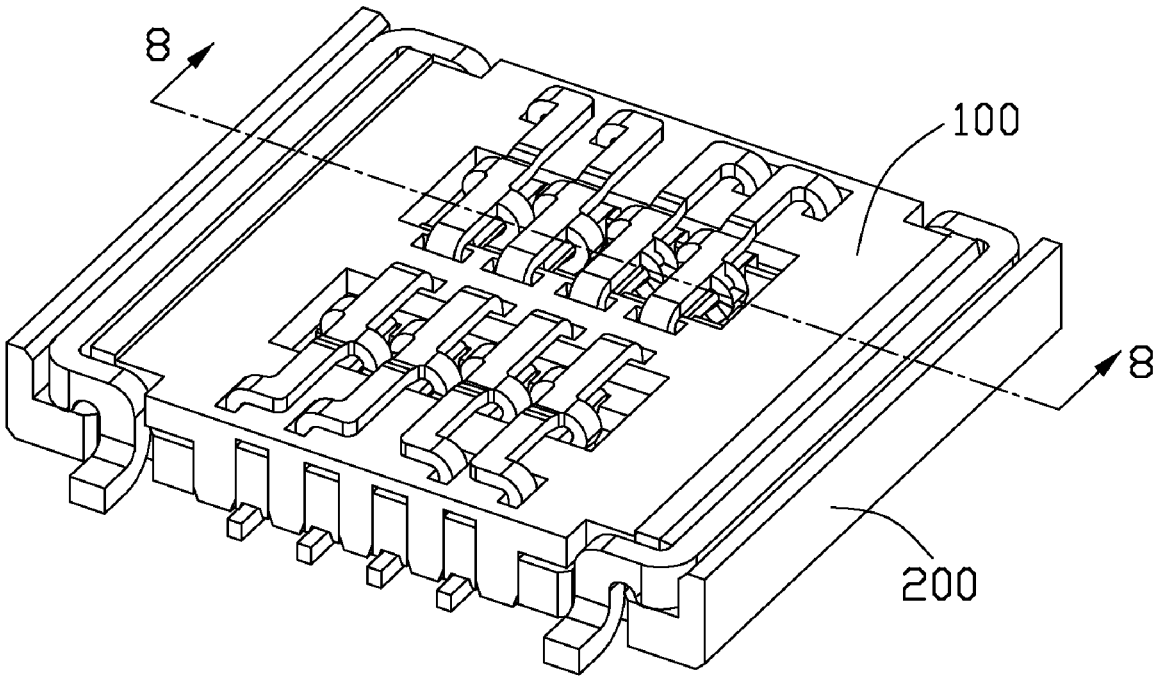
FIG. 3 shows the first connector and the second connector in mated state.
Figure 4:
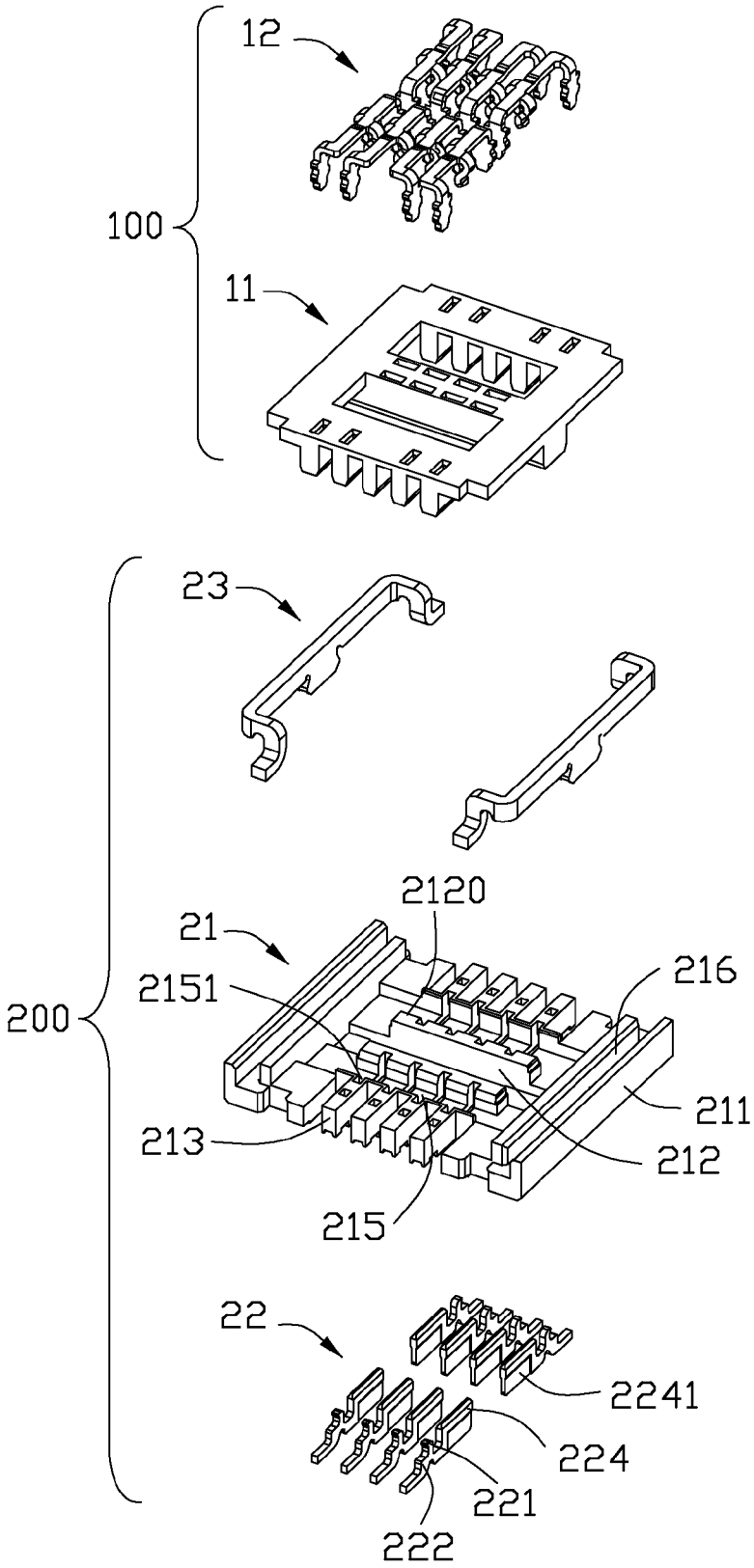
FIG. 4 is an exploded perspective view of the first connector and the second connector.
Figure 5:
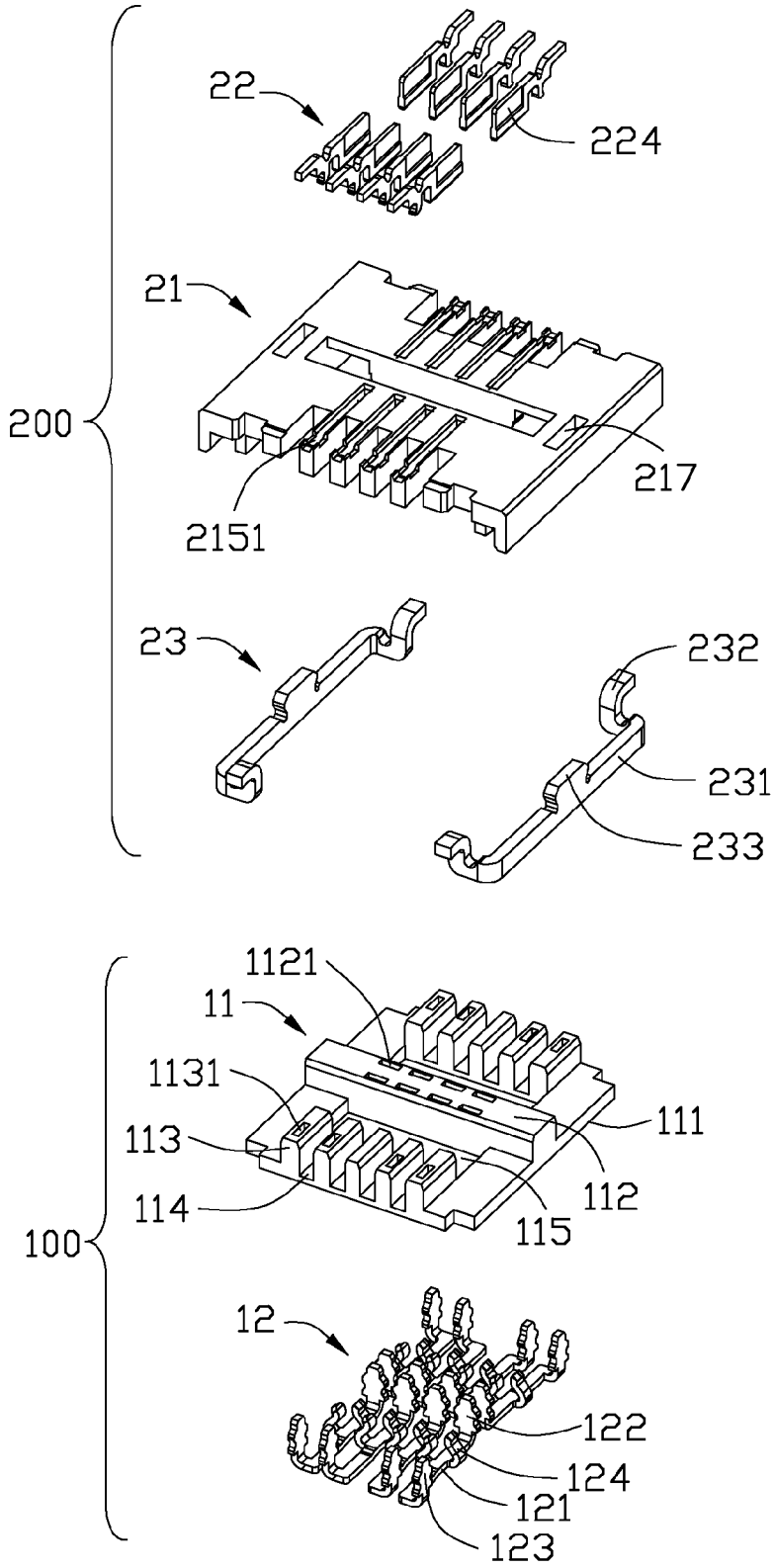
FIG. 5 is similar to FIG. 4, but viewed from other direction.
Figure 6:
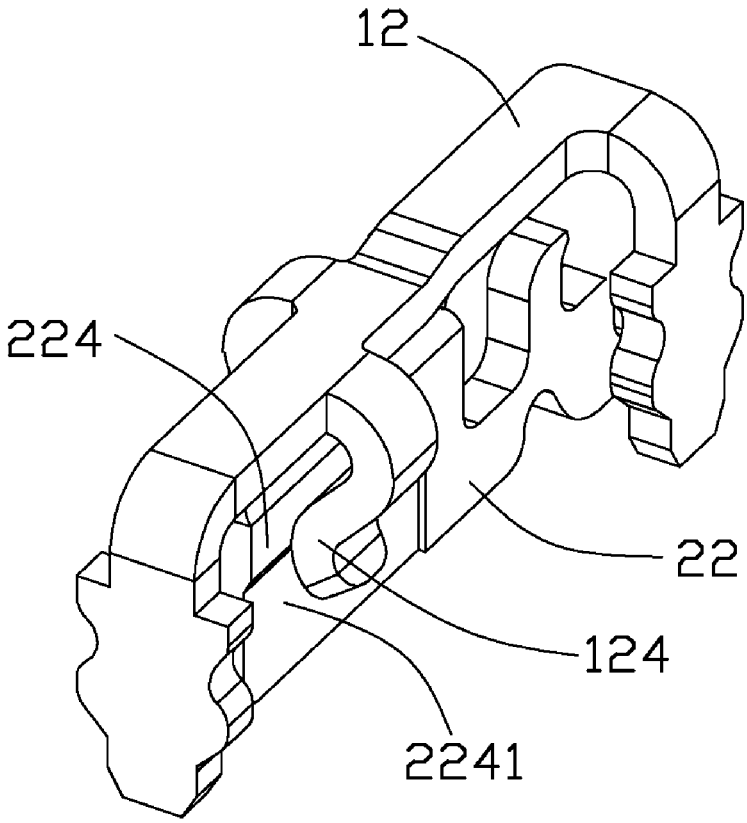
FIG. 6 illustrates a first terminal of the plug connector mating with a second terminal of the second connector.
Figure 7:
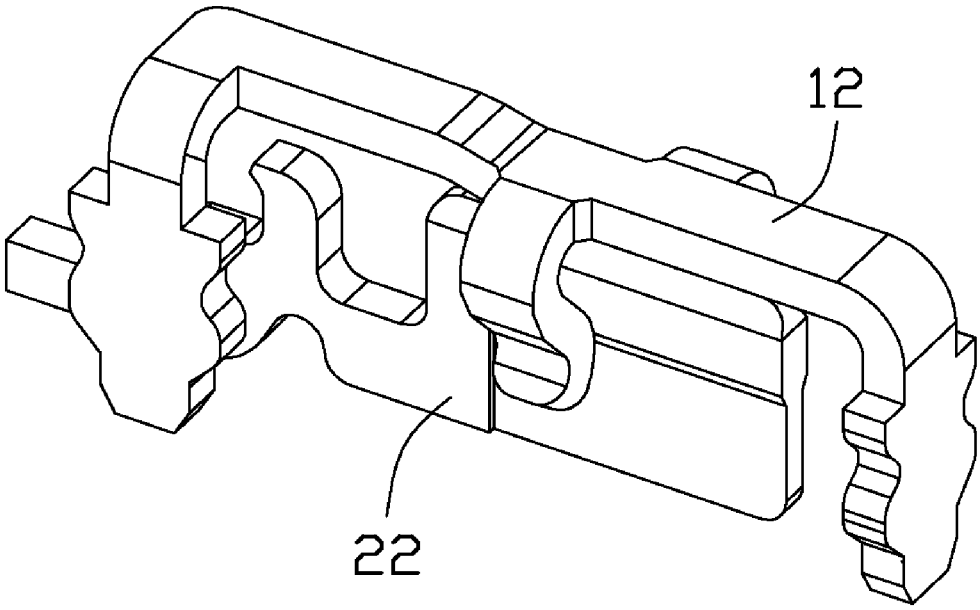
FIG. 7 is similar to FIG. 6, but viewed from other direction.
Figure 8:
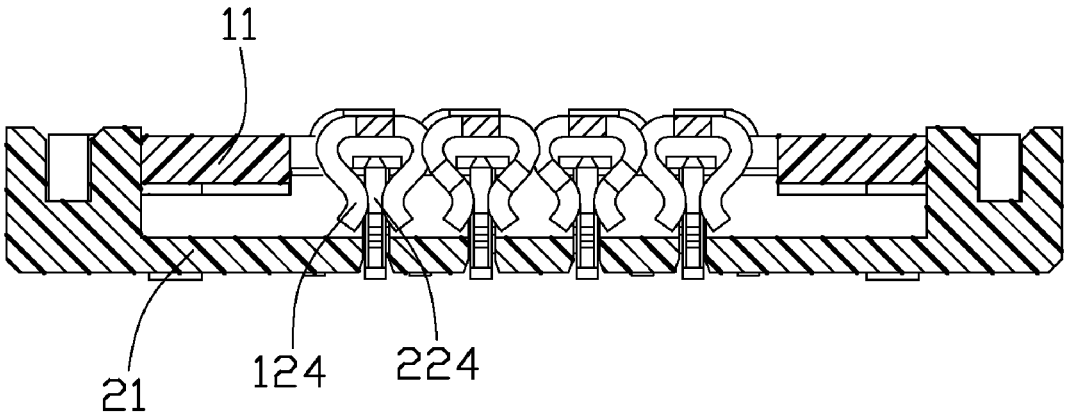
FIG. 8 is a cross-section view of FIG. 3 taken along line 8-8.

Referring to FIGS. 1-8, a connector assembly 1000 in accordance with the present invention comprises a first connector/plug connector 100 and a second connector/receptacle connector 200 both adapted for mounting to corresponding printed circuit boards (not shown) respectively.

The first connector/plug connector 100 includes a first insulative housing 11, a plurality of first terminals 12 supported by the first insulative housing 11.

The first insulative housing 11 has a base portion 111, a transversal beam 112 formed on a middle section of the base portion 111, a plurality of first vertical walls 113 formed on a front segment and a back segment of the base portion 111 and disposed at opposite sides of the transversal beam 112. There are a plurality of first positioning holes 1121 defined in the transversal beam 112 and separated into two transversal sets. The first vertical walls 113 are arranged into two transversal sets along a transversal direction, and there is a longitudinal passage 114 formed between each two adjacent first vertical walls 113, therefore the first vertical walls 113 are spaced apart from each other by the longitudinal passages 114. Furthermore, there is a second positioning hole 1131 located in each first vertical wall 113, except for the first vertical wall 113 at a middle of each transversal set. In addition, there are two transversal slots 115 located between the transversal beam 112 and the first vertical walls 113 at opposite sides of the transversal beam 112. From another viewpoint, the transversal slot is essentially located in the inner part of the first housing 11 while the first vertical walls 13 alternately arranged with the longitudinal passages therein are located on the outer part of the housing.

The first terminals 12 are divided into two sets along the longitudinal direction, and each set of the first terminals 12 arranged along the transversal direction. Each first terminal 12 has a planar body portion 121 located at a horizontal plane, a first retention portion 122 formed at a first end (front end) of the body portion 121, a second retention portion 123 formed at a second end (back end) of the body portion 121, and two contacting portions 124 connected with lateral edges of the body portion 121. The first retention portion 122 is located in a vertical plane parallel to the transversal direction, while the second retention portion is located in another vertical plane which is parallel to the longitudinal direction but perpendicular to the transversal direction. Therefore, the first retention portion 122 is perpendicular to the second retention portion 123. The two contacting portions 124 are disposed between the first and second retention portions 122, 123 and further arranged in staggered manner. The first retention portion 122, the second retention portion 123 and the two contacting portions 124 extend along same direction, i.e., up-to-down direction.

The first terminals 12 are mounted to the first insulative housing 11, with the first retention portions 122 respectively engaged with the first positioning holes 1121 defined in the transversal beam 112, the second retention portions 123 respectively engaged with positioning holes 1131 located in the first vertical walls 113, and the contacting portions 124 received in the transversal slot 115.

The second connector/receptacle connector 200 includes a second insulative housing 21, a plurality of second terminals 22 supported by the second insulative housing 21 and two retainers 23 assembled with the second insulative housing 21.

The second insulative housing 21 has a base portion 211, a transversal slot 212 formed between two corresponding transversal bars 2120 which are located in a middle section of the base portion 211, a plurality of second vertical walls 213 arranged into two transversal sets and formed on a front segment and a back segment of the base portion 211 and disposed at opposite sides of the transversal slot 212. There are two transversal cavities 215 respectively arranged between a corresponding transversal bar 2120 and a corresponding set of the second vertical walls 213 which are separated from one another via a plurality of lengthwise grooves (not labeled) each between adjacent two second vertical walls 213. There are a plurality of terminal grooves 2151 each defined in the corresponding second vertical wall 213 and further extends into the corresponding transversal bar 2120. The terminal grooves 2151 further communicate with the corresponding transversal cavity 215.

The second terminals 22 are divided into two sets along the longitudinal direction, and each set of the second terminals 22 arranged along the transversal direction. Each second terminal 22 has a body portion 221 extending along the longitudinal direction, a retention portion 222 projecting upwardly from a top edge of the body portion 221, and a contacting portion 224 connected with the body portion 221 and extending longitudinally therefrom. The contacting portion 224 is of blade type and disposed in a vertical plane. There are two dimples 2241 respectively located at opposite sides of the contacting portion 224.

The second terminals 22 are mounted to the second insulative housing 21, with the retention portion 222 and the contacting portion 224 received in the corresponding terminal groove 2151, the body portion 221 exposed outward of the second insulative housing 21, and the contacting portion 224 partially accommodated in the transversal cavity 215 too.

Each retainer 23 has a main body 231, two L-shaped feet 232 connected to opposite ends of the main body 231 and disposed under the main body 231, and a tab 233 formed on a middle segment of a top side of the main body 231. The two retainers 23 are respectively mounted to two mounting passages 216 which are respectively defined at opposite sides of the second insulative housing 21. In addition, the tab 233 is inserted into a positioning hole 217 which is located in a middle of the mounting passages 216.

When the first connector 100 mates with the second connector 200, the transversal beam 112 is received in the transversal slot 212, the two contacting portions 124 of each first terminal 12 accommodated in the corresponding transversal cavity 215, with the contacting portions 224 of the second terminals 22 respectively interposed between the two contacting portions 124 of the corresponding first terminal 12, thus the two contacting portions 124 sandwich and are positioned in two dimples 2241 of the contacting portion 224. The second vertical walls 213 are respectively inserted into longitudinal passages 114. Therefore, the first connector 100 and the second connector 200 engage with other reliably.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A connector assembly, comprising:

a first connector including a first insulative housing, a plurality of first terminals supported by the first insulative housing, each first terminal having a body portion and two contacting portions connected with lateral edges of the body portion; and a second connector including a second insulative housing, a plurality of second terminals supported by the second insulative housing, each second terminal having a body portion and a blade type contacting portion;

wherein the contacting portion of each second terminal is sandwiched between the two contacting portions of the corresponding first terminal when the first connector mates with the second connector;

wherein the first terminal has two retention portions formed at opposite ends of the body portion;

wherein the two retention portions project downwardly; and wherein the two retention portions are perpendicular to each other.

2. The connector assembly as claimed in claim 1, wherein there are two dimples defined at opposite sides of the contacting portion of the second terminal, and the two contacting portions of the first terminal are located in the two dimples, respectively.

3. The connector assembly as claimed in claim 1, wherein the two contacting portions of the first terminals are arranged in staggered manner.

4. The connector assembly as claimed in claim 1, wherein the body portion of the first terminal is located at a horizontal plane.

5. The connector assembly as claimed in claim 4, wherein the two contacting portions of the first terminal extend downwardly from the body portion.

6. A connector assembly, comprising:

a first connector including:

a first insulative housing having a base portion, a plurality of first vertical walls formed on the base portion and arranged in at least one row along a transversal direction, and the first vertical walls spaced apart from each other by a number of longitudinal passages, and a transversal slot disposed proximate to the longitudinal passages;

a plurality of first terminals supported by the first insulative housing, each first terminal having a body portion, at least one retention portion and at least one contacting portion, the retention portion inserted into a corresponding first vertical wall, and the contacting portion extending into the transversal slot;

a second connector for mating with the first connector, including:

a second insulative housing having a base portion, a plurality of second vertical walls formed on the base portion and arranged in at least one row along a transversal direction, and a transversal cavity disposed proximate to the vertical walls;

a plurality of second terminals supported by the second insulative housing, each second contact having a body portion, a retention portion and a contacting portion, the retention portion inserted into a corresponding second vertical wall, and the contacting portion extending into the transversal cavity; and wherein the contacting portions of the first terminals are adapted for mating with the contacting portions of the second terminals, respectively; and the longitudinal passages of the first insulative housing are adapted for accommodating the second vertical walls of the second insulative housing.

7. The connector assembly as claimed in claim 6, wherein each of the first terminals has two contacting portions, and each of the second terminals has a blade type contacting portion interposed between the two contacting portions of the first terminal.

8. The connector assembly as claimed in claim 6, wherein the first insulative housing has two rows of the first vertical walls respectively formed on a front and back segment of the base portion and a transversal beam formed on a middle segment of the base portion.

9. The connector assembly as claimed in claim 8, wherein each of the first terminals has two retention portions formed at opposite ends of the body portion, and one of the retention portions is engaged with the transversal beam, and the other of the retention portions is engaged with the first vertical wall.

10. The connector assembly as claimed in claim 9, wherein one of the retention portion is located in a vertical plane which is parallel to the transversal direction while the other of the retention portion is located in another vertical plane which is perpendicular to the transversal direction.

11. The connector assembly as claimed in claim 8, wherein the second insulative housing has two rows of the second vertical walls respectively formed on a front and back segment of the base portion and two transversal bars located in a middle section of the base portion.

12. The connector assembly as claimed in claim 11, wherein there is a transversal slot located between the two transversal bars for receiving the transversal beam of the first insulative housing.

13. An electrical connector assembly comprising:

a first connector including:

a first insulative housing defining a lengthwise direction and a transverse direction perpendicular to each other and forming an inner portion and an outer portion side by side arranged with each other in the lengthwise direction;

a plurality of first contacts disposed in the first housing and arranged with one another along the transverse direction while each of said first contacts essentially extends in the lengthwise direction and defines a first retention section retained to the first housing and a first contacting section;

a transverse slot formed in the inner portion and extending along the transverse direction to an extent corresponding to all said first contacts wherein the first contacting sections extend into the transverse slot;

a second connector adapted to be mated with the first connector, including:

a second insulative housing defined along said lengthwise direction and said transverse direction and forming an inner part and an outer part side by side arranged with each other in the lengthwise direction;

a plurality of second contacts disposed in the second housing and arranged with one another along the transverse direction while each of said second contacts essentially extends in the lengthwise direction and defines a second retention section retained to the second housing and a second contacting section;

a transverse cavity extending in the inner part along the transverse direction to an extent corresponding to all said second contacts wherein the second contacting sections extend into the transverse cavity; wherein when mated, the outer portion of the first connector is aligned with the outer part of the second connector in a vertical direction perpendicular to both said lengthwise direction and said transverse direction, and the inner port of the first connector is aligned with the inner part of the second connector in the vertical direction under condition that the transverse slot and the transverse cavity are not only aligned with each other in the vertical direction but also overlapped with each other in the transverse direction so as to have the first contacting sections are mechanically and electrically connected, respectively, to the corresponding second contacting sections in the transverse direction.

14. The electrical connector assembly as claimed in claim 13, further comprising a plurality of spaced passages extending through the outer portion in the lengthwise direction to form a plurality of first vertical walls thereof corresponding under condition that each of said passages is located between every adjacent two first vertical walls, and a plurality of spaced grooves extending in the outer part along the lengthwise direction to form a plurality of second vertical walls thereof correspondingly under condition that each of the grooves is located between every adjacent two second vertical walls.

15. The electrical connector assembly as claimed in claim 14, wherein when mated, the first vertical walls are received in the corresponding transverse grooves, respectively, and the second vertical walls are received in the corresponding transverse passages, respectively, thus forming an alternate arrangement of said first vertical walls and said second walls in the transverse direction.

16. The electrical connector assembly as claimed in claim 14, wherein the first retention section is retained to the corresponding first vertical wall, and the second retention section is retained to the corresponding second vertical wall.

17. The electrical connector assembly as claimed in claim 13, wherein each of said second contacts essentially lies in a plane defined by the corresponding second vertical wall in the lengthwise direction while each of the first contacts defines a portion aligned in the corresponding first vertical wall and another portion aligned with the corresponding passage aside.

* * * * *